US005971902A

United States Patent [19]

Robertson et al.

[11] Patent Number: 5,971,902

[45] Date of Patent: Oct. 26, 1999

[54] LUMBAR EXTENSION MACHINE

[76] Inventors: Virgil L. Robertson, 28 Rancho Naviato Dr., Philips Ranch, Calif. 91766; Joe L. Verna, 2628 Presidio La., Corona Hills, Calif. 91719; Eric A. Pierra, 701 W. Imperial Highway, Unit 308, La Habra, Calif. 90631

[21] Appl. No.: 09/167,779

[22] Filed: Oct. 7, 1998

Related U.S. Application Data

[60] Provisional application No. 60/061,415, Oct. 8, 1997.

[51] Int. Cl.[6] ..... A63B 23/02

[52] U.S. Cl. ..... 482/142; 482/143; 482/144; 482/145; 482/907; 601/24

[58] Field of Search ..... 482/140, 907, 482/142–145; 601/24

[56] References Cited

U.S. PATENT DOCUMENTS 4,292,962 10/1981 Krause ..... 482/145
5,190,513 3/1993 Habing et al. ..... 482/145
5,840,001 11/1998 Schedel ..... 482/142

*Primary Examiner*—John Mulcahy
*Attorney, Agent, or Firm*—Cleveland R. Williams

[57] ABSTRACT

The present invention resides in an exercise apparatus for individuals with chronic back pain. The apparatus comprises an elongated base frame that is rectangular in configuration and has a U-shaped front portion and a T-shaped back portion. An inverted Y-shaped, lower support shaft having three members with rectangular configurations is removably attached to the base frame. An elongated, rectangular shaped upper support shaft attached to an angle adjustment cam is attached to the inverted Y-shaped lower support shaft with rotation and locking means. The upper support shaft contains, near the bottom portion thereof, a restraint stand having foot boards and lower extremity restraint. The upper support shaft is hollow on the inside and is slidably connected to a telescoping pelvic restraint stand, which contains hip pads, pelvic restraints and bicycle like handle bars near the top portion thereof. The upper support shaft also contains locking and stabilizing means for securing the telescoping pelvic restraint stand.

15 Claims, 4 Drawing Sheets

LUMBAR EXTENSION MACHINE

This application claims benefit of provisional application No. 60/061,475, filed Oct. 8, 1997.

BACKGROUND OF THE INVENTION

1. Field of the Invention

The present invention resides in a Lumbar Extension Machine which is a trunk extension exercise device for the human body. It should be noted that the LUMBAR EXTENSION MACHINE is a new and improved version of the VARIABLE ANGLE ROMAN CHAIR. The device is especially helpful in alleviating chronic low back pain of individuals suffering from severe disability and deconditioning syndrome.

In the past, devices for exercising individuals suffering from chronic low back pain were stationary at approximately 0° and 45° angles at the restrained pelvic portion of the device. These angles are very difficult for the initial use of such a device by some individuals. Through continued research by the inventors herein, it was determined that by varying the angle of the restrained pelvic portion of this invention from 0° to 75° from horizontal, that a severely disabled individual suffering from chronic low back pain could exercise at a more vertical angle where resistance is lower (i.e. 75°) and progressively move to more difficult angles (i.e. 0°) by virtue of a progressive resistance exercise program utilizing this device.

2. Description of the Prior Art

Numerous exercise devices exist for strengthening the various muscles of the human body. It should be noted, however, that exercises to strengthen a particular group of muscles have limitations because of the various muscle interactions. In particular, exercises for the muscles of the trunk are especially difficult to accomplish because of interaction of the back muscles with other quite powerful muscles, particularly those of the legs. Thus, stabilization of the pelvic region during the exercise is quite important. In particular, stabilization of the pelvis to prevent rotation of said pelvis during an exercise routine is needed to isolate the lumbar region of the trunk and provide for an acceptable exercise device.

Several devices have been proposed in the past to exercise various muscles on the human body.

For example, U.S. Pat. No. 4,564,193 to Stewart describes an adjustable exercise apparatus which consists of a frame, a base supporting said frame, a cable system, a guide rod supported on said frame and a weight lift slidable along said guide rod and attached to said cable system. Auxiliary apparatus such as a bicycle device, weight bench and trampoline are also disclosed.

U.S. Pat. No. 4,832,336 to Lahman relates to a multipurpose exercising device which consists of an elongated frame having coplanar top and bottom surfaces and front and rear ends. A pivotally mounted support post is mounted near the rear end of the frame which provides for holding a pad positioned on top of the frame at an elevated angular position or extends from the rear end of the frame. A biceps femoris attachment is detachably mounted on the rear end of the frame. The device is particularly suitable for exercising abdominal muscles which can be converted to a biceps femoris exerciser.

U.S. Pat. No. 4,907,798 to Burchatz describes an exercise machine consisting of a vertically elongated open frame of sufficient height for an average individual to stand inside of it. The frame contains weights, a cable system attached to said weights, a single handle bar or a single foot bar and a bench having a front section joined by a lateral hinge to a rear back rest section.

U.S. Pat. No. 5,042,801 to Sterba, et al. relates to an exercise bench system having a lower bench that rests on a floor and contains a separate upper bench which can be adjusted to three separate positions; namely, (1) collapsed flat on the lower bench, (2) inclined relative to the lower bench and (3) upstanding parallel with the lower bench.

U.S. Pat. No. 5,110,121, to Foster discloses an exercise chair for the lower back. The chair contains both anterior and posterior pelvic restraints to prevent rotation of the pelvic region during an exercise routine. A variable resistance mechanism is inclined on the chair for selectively varying the forces that must be overcome during an exercise movement which consists of forcing the back of the chair rearwardly from an initially forward position.

U.S. Pat. No. 5,160,305 to Lin relates to a multifunctional gym exerciser containing an adjustable table. The apparatus contains a plurality of set holes wherein a user can attach a variety of exercise attachments. In addition, the table portion of the apparatus can be adjusted to a desired slope in order to achieve the best exercise effect.

U.S. Pat. No. 5,308,306 to Wang describes an abdomen exercising apparatus. The apparatus has a back rest supported on two curved supports at two opposite sides of a base by two cranks and two elastic elements. The elastic elements produce an upward force to help the user set up.

SUMMARY OF THE INVENTION

The present invention resides in an exercise apparatus for individuals with chronic back pain comprising a lower, elongated base frame having a front and back. The elongated base frame is rectangular in configuration and has a U-shaped front portion and a T-shaped back portion.

An elongated, rectangular shaped upper support shaft contains, near the bottom portion thereof, a restraint stand having a foot board or rest and a lower extremity restraint. The lower extremity restraint contains a pair of pads for receiving the lower extremity of an individual. A telescoping pelvic restraint stand is slidably attached to and contained inside the elongated, rectangular shaped upper support shaft by sliding and locking means. The telescoping pelvic restraint stand contains hip pads, pelvic restraints and bicycle like handle bars near the top portion thereof. In combination with each other, the telescoping pelvic restraint stand and elongated, rectangular shaped upper support shaft supports the human body of an individual with chronic back pain.

The elongated, rectangular shaped support shaft contains an angle adjustment cam with locking and stabilizing means. An inverted Y-shaped, lower shaft is movably attached to the base frame near the center portion thereof. The inverted Y-shaped, lower support shaft is hingably attached to the upper rectangular shaped support near the angle adjustment cam.

BRIEF DESCRIPTION OF THE DRAWINGS

The invention is more readily described by the following drawings where.

DETAILED DESCRIPTION OF THE INVENTION

Figure 1:
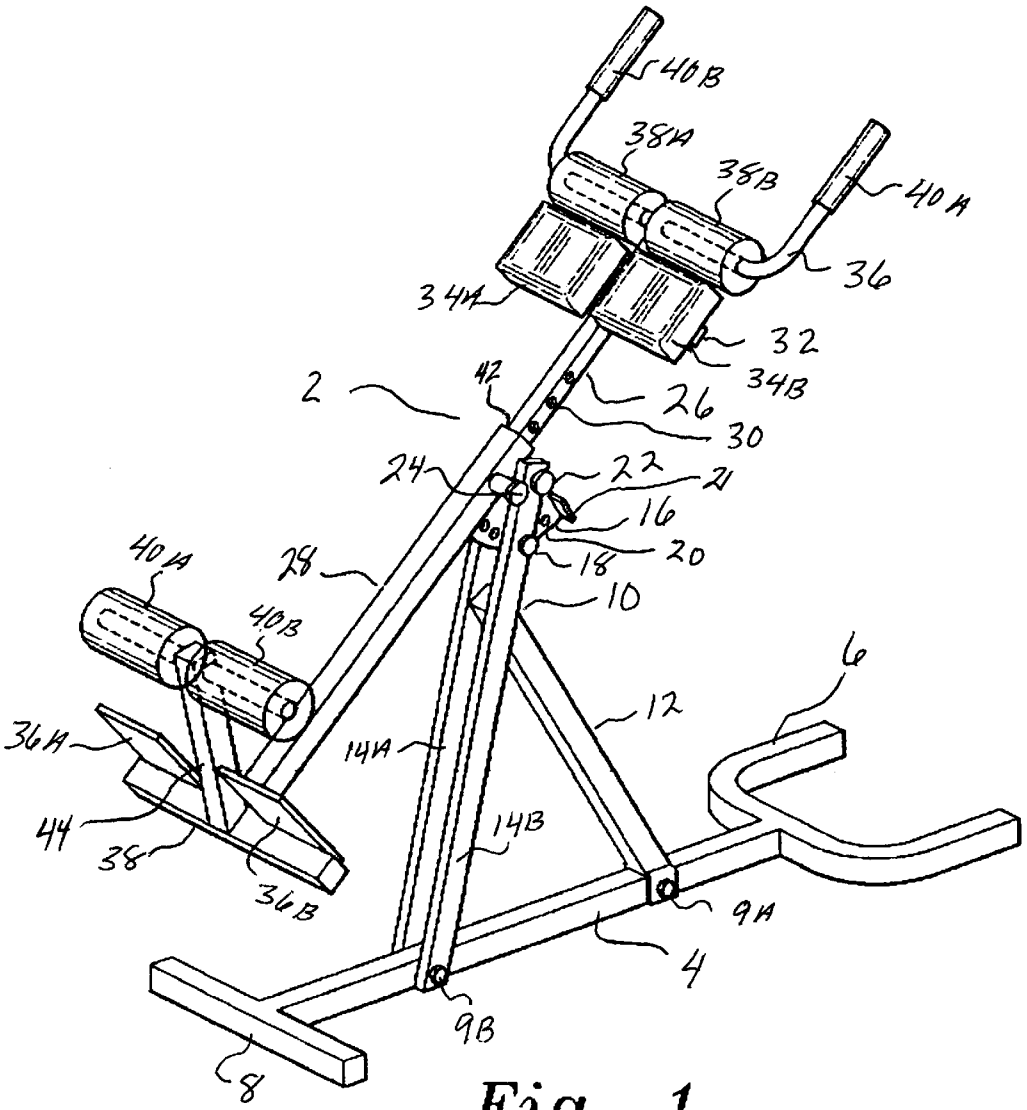
FIG. 1 is a back perspective view of the LUMBAR EXTENSION MACHINE (LEM).

The present invention comprises a Lumbar Extension Machine exercise device which is especially helpful in alleviating pain experienced by individuals suffering from chronic low back pain, due to severe lumbar dysfunction and deconditioning syndrome. The device is a trunk extension exercise device for the human body. The Lumbar Extension Machine is herein referred to as the LEM. It is to be noted that the LUMBAR EXTENSION MACHINE is a new and improved version of the VARIABLE ANGLE ROMAN CHAIR.

With reference now to the drawings, FIGS. (1 to 4) depict the LEM (2) herein which shows a bottom rectangular-shaped elongated, support base frame (4) having a U-shaped (6) front portion and a T-shaped (8) back portion. The construction of the base frame eliminates the need for additional stabilizers to prevent the LEM from tipping over in use.

An inverted Y-shaped, lower support shaft (10) is removably attached to lower base support frame (4) using screw threads and nuts (9A and 9B). Inverted Y-shaped, lower shaft (10) is rectangular in configuration and contains two outer members (14A and 14B) and center member (12) which is attached at an angle to the two outer members (14A and 14B) at approximately one-third (⅓) distance from the top portion of said inverted, Y-shaped lower support member (10). All three members of the inverted, Y-shaped lower support (10) attach to bottom support base frame (4) near the bottom portion thereof.

An elongated, rectangular shaped upper support shaft (28) contains a lower T-shaped, portion (38). Foot stands (36A and 36B) are attached to lower T-shaped, portion (38) and support the feet of an individual utilizing the LEM. An upward projecting, rectangular shaped shaft (44) is attached to lower T-shaped portion (38) of support shaft (28) and contains two lower extremity restraints (40A and 40B). Lower extremity restraints (40A and 40B) are cylindrical in configuration with padded surface area and are designed to fit behind the ankles or the back portion of the lower extremity of an individual.

Upper support shaft (28) is hollow and has an opening (42) near the top portion thereof. A rectangular shaped, telescoping pelvic restraint (26) is slidably attached and fits into the opening (42) of upper support shaft (28). The telescoping pelvic restraint stand (26) has a series of spaced holes (30) drilled into the side portion thereof. The upper support stand (28) contains spring loaded pull pin (24) on one side and a torsion or tighten down knob on the other side. Telescoping pelvic restraint (26) is slidably adjusted to the proper height for the individual using the LEM and the spring loaded pull pin (24) is released where the pin (24) penetrates the desired hole (30) in the telescoping pelvic restraint stand (26) thus immobilizing it. The tighten down knob is located on the other side of the upper support shaft (28) and is tightened, applying pressure on pelvic restraint stand (26) thus stabilizing it. Telescoping pelvic restraint stand (26) contains support (32) for two hip pads (34A and 34B) near the top portion thereof. The upper portion of telescoping pelvic restraint stand (26) contains a handle bar shaped extension (36) which additionally contains two pelvic restraint pads (38A and 38B) and handle bar grips (40A and 40B). It should be noted that pelvic restraint pads (38A and 38B) are cylindrical in configuration.

Angle adjustment cam (16) is permanently attached to the bottom of upper support shaft (28) near the top portion thereof, angle adjustment cam (16) is semi-circular in configuration and has holes (20) drilled through the outer portion thereof at 15 degree increments. The angle adjustment cam (16) which is permanently attached to upper support shaft (28) for example by welding, is rotatably attached to the inverted Y-shaped lower support shaft (10) by a cold roll cylindrical shaft or axle (22) which contains bronze oil light T-flange bushings on both ends. The T-flange bushings fit around the ends of the cylindrical shaft (22) and are held in place by button head screws which are screwed into the ends of said axel. Angle adjustment cam (16) fits between the upper portion of the two outer members (14A and 14B) of Y-shaped support shaft (10).

Matching holes are drilled into each of the outer members (14A and 14B) of the inverted Y-shaped, lower shaft (10) near the top portion thereof. The holes are adapted to receive a spring loaded pull pin (18). The holes of the two members (14A and 14B) of the lower shaft (10) are constructed to align with the holes of the angle adjustment cam (16). The angle of the upper support shaft is adjusted by rotating the upper shaft (28), including the angle adjustment cam (16) on the cylindrical shaft (22) and stopping at the desired angle represented by holes (18) drilled into said adjustment cam (16) at 15 degree increments. A spring loaded pull pin (18) attached to one of the two members (14A and 14B) of the lower shaft (10) secures the upper support shaft (28) at the desired angle by pulling the pin (18) out, rotating the cam (16) to the desired angle, releasing the pull pin (18) thus allowing it to pass through the desired hole (20) in the angle adjustment cam (16) and the hole in the other outer support members (14A and 14B), thus securing the upper shaft at the desired angle.

Figure 3:
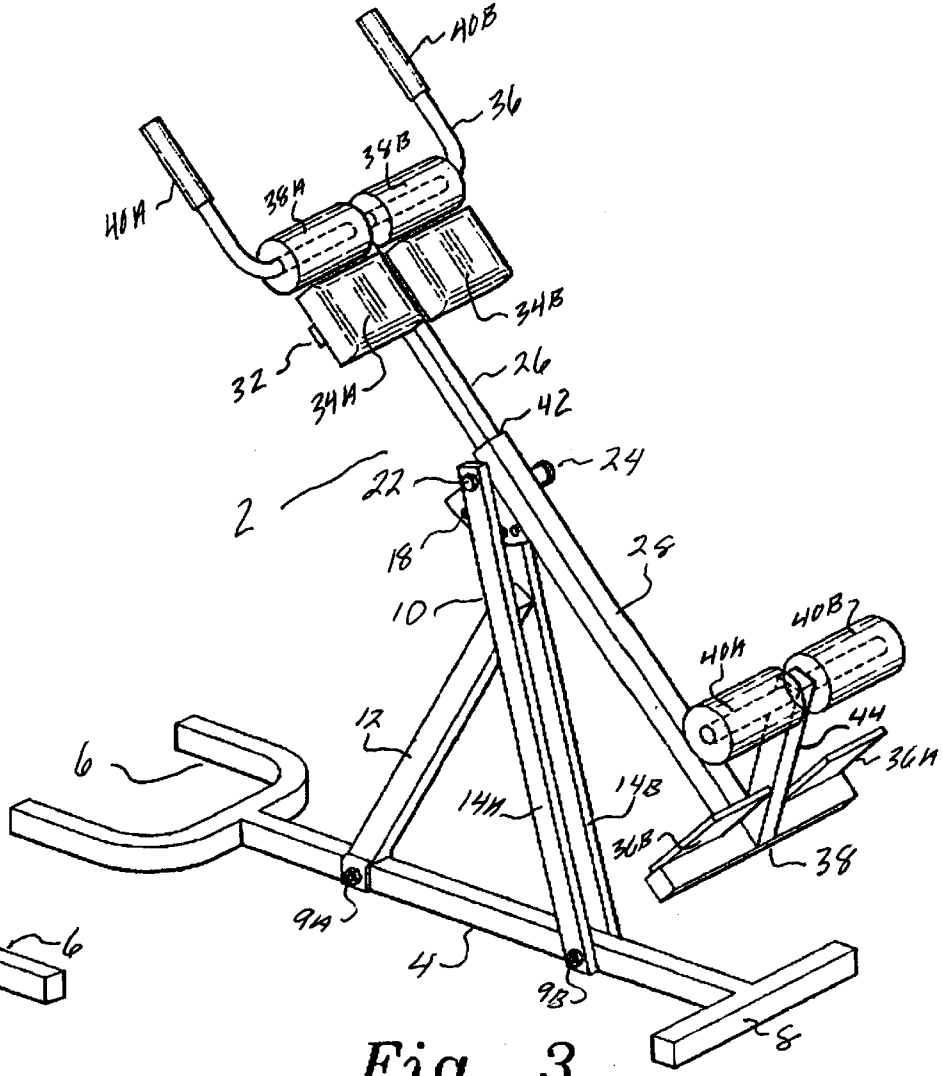
FIG. 3 is a back perspective view of the LUMBAR EXTENSION MACHINE that has been rotated 180 degrees from the view in FIG. 1.
Figure 2:
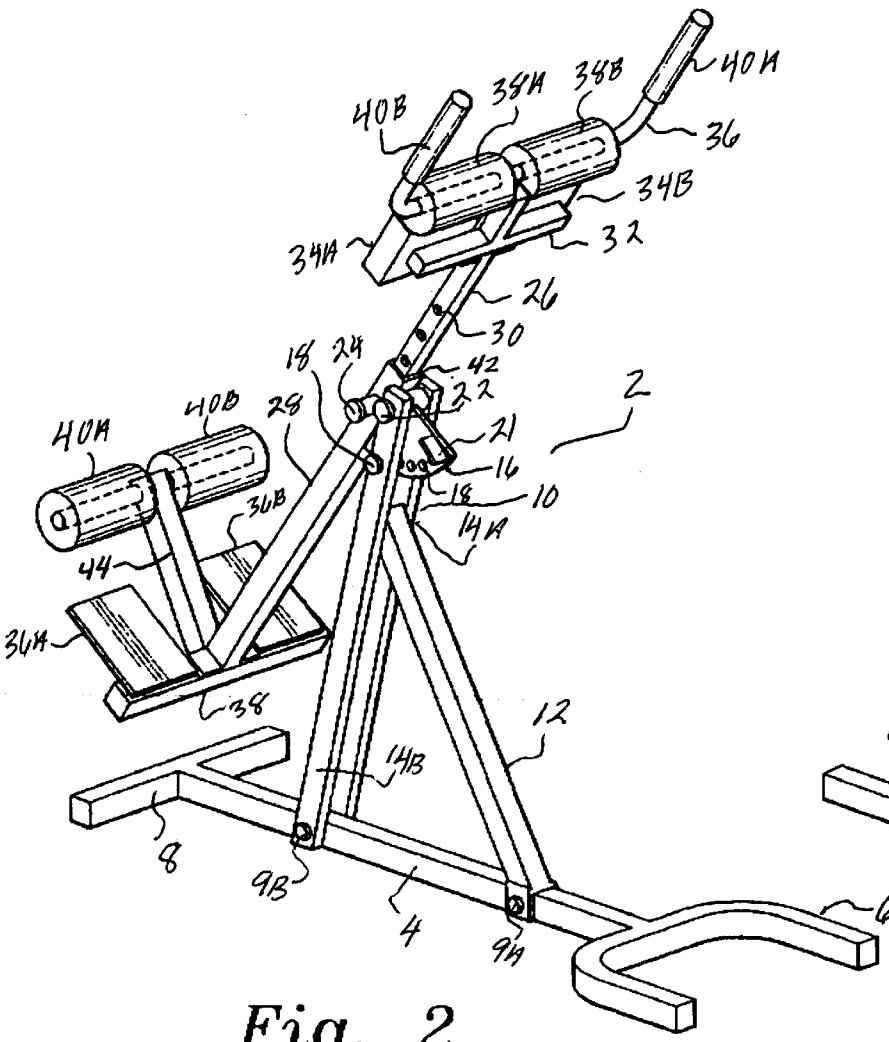
FIG. 2 is a front perspective side view of the LUMBAR EXTENSION MACHINE.
Figure 4:
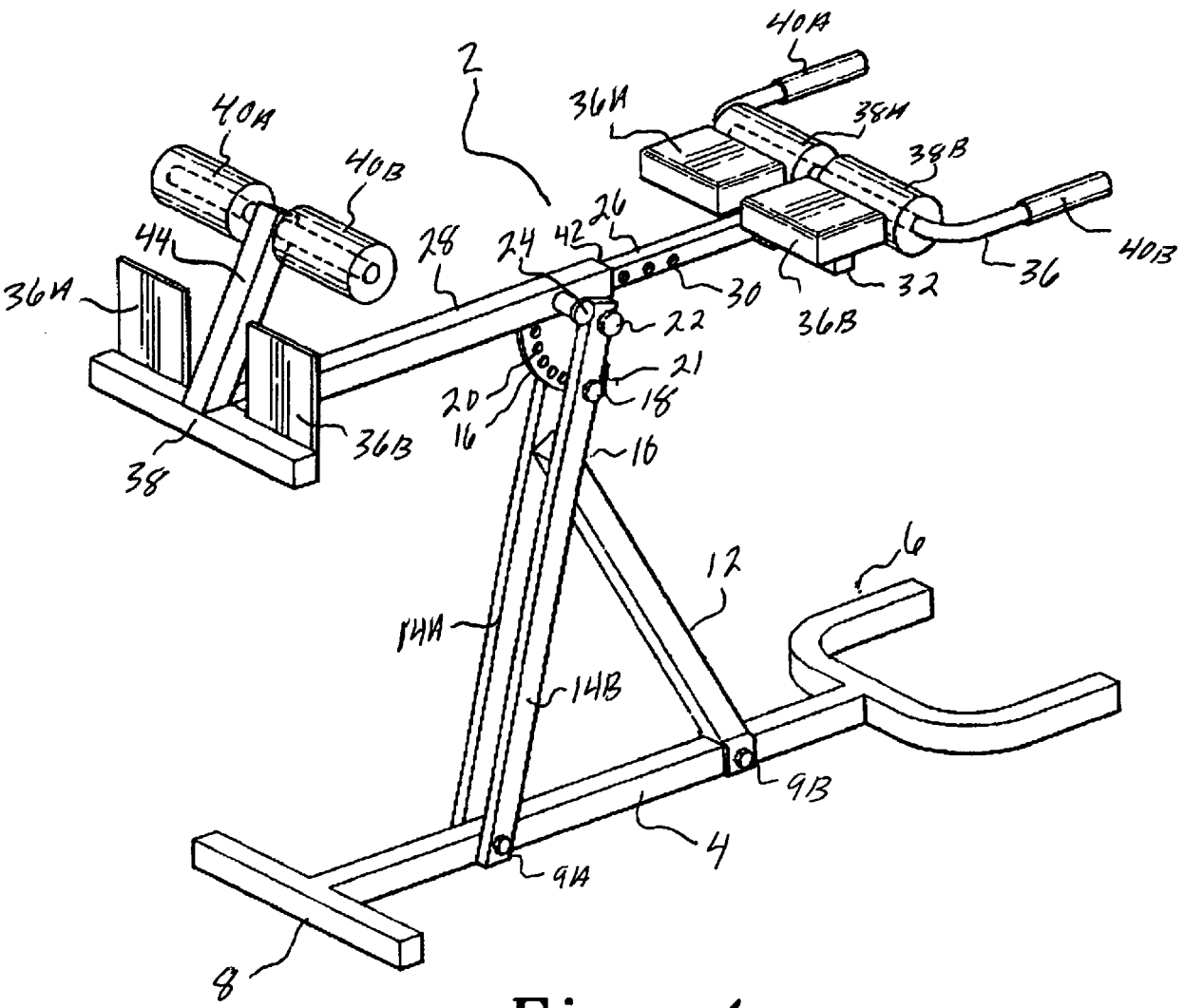
FIG. 4 is a side perspective view of the LUMBAR EXTENSION MACHINE.

In use position, an individual substantially as shown in FIGS. 1 to 4, stands on the foot rest (36A and 36B) of the LEM (2), rests his hips and pelvic on the hip pads (34A and 34B) and pelvic restraint pads, places the heels of his feet against the lower extremity restraint (40A and 40B) and begins his exercise routine. The upper support frame (28), including the telescoping pelvic restraint stand (26), can be adjusted from angles of zero degrees (0°) to seventy five degrees (75°) as measured from a horizontal plane.

Figure 5:
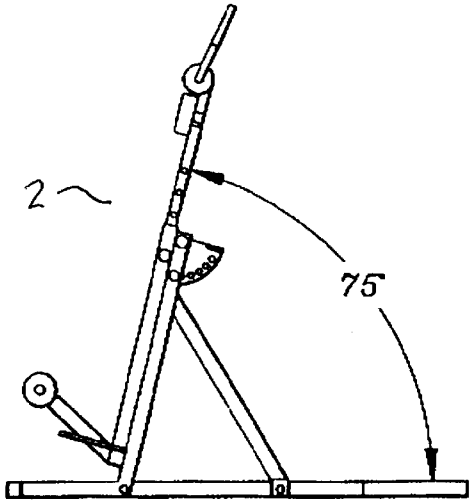
FIG. 5 is a side view of the LUMBAR EXTENSION MACHINE at a 75 degree angle.
Figure 6:
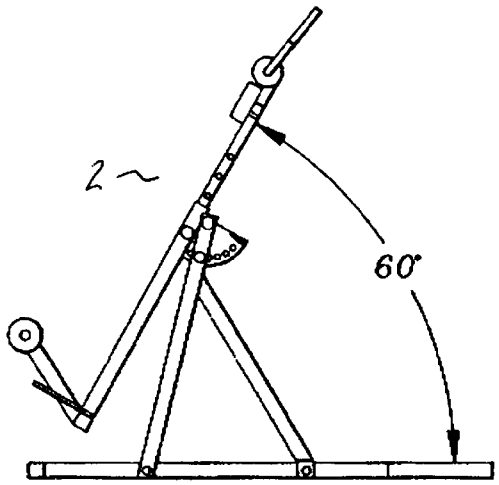
FIG. 6 is a side view of the LUMBAR EXTENSION MACHINE at a 60 degree angle.
Figure 7:
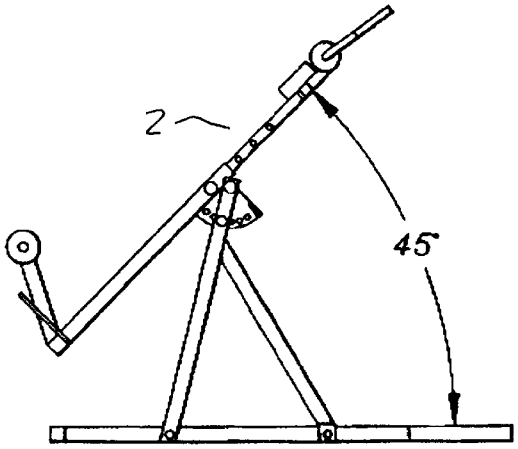
FIG. 7 is a side view of the LUMBAR EXTENSION MACHINE at a 45 degree angle.
Figure 8:
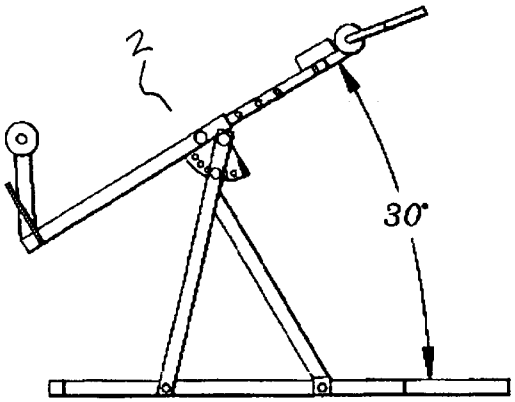
FIG. 8 is a side view of the LUMBAR EXTENSION MACHINE at a 30 degree angle.
Figure 9:
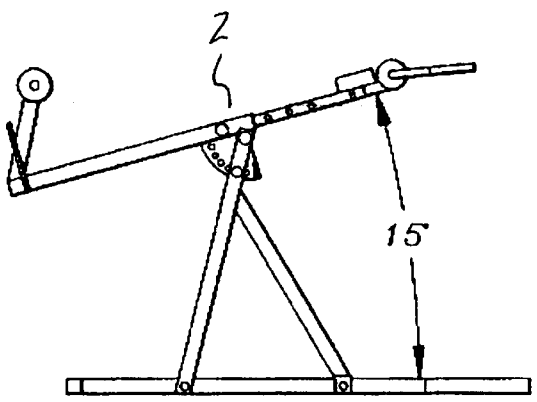
FIG. 9 is yet another side view of LUMBAR EXTENSION MACHINE at a 15 degree angle.
Figure 10:
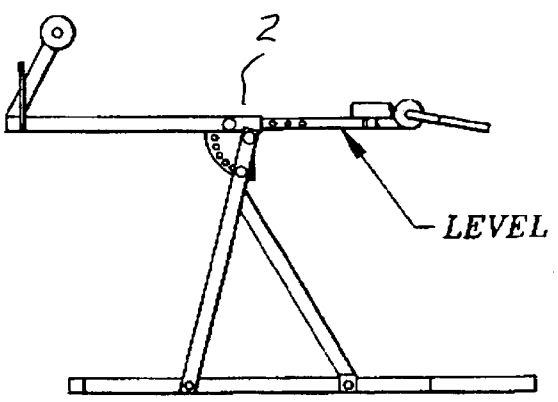
FIG. 10 is a side view of the LUMBAR EXTENSION MACHINE in the level position.

FIGS. 5 to 10 show the LEM (2) at angles from approximately level to about 75 degrees in 15 degree intervals from a horizontal plane.

It should be noted that many modifications and variations to this invention may be made without departing from the spirit and scope thereof and therefore only such limitations should be made as indicated by the appended claims.

We claim:

1. A Lumbar Extension Machine which comprises a bottom, elongated base frame having a U-shaped front portion and a T-shaped back portion, an inverted Y-shaped, lower support shaft that is removably attached to the elongated base frame, an upper support shaft having lower extremity restraining means and an angle adjustment cam which is attached to the inverted Y-shaped lower shaft with angular rotation and locking means, and a telescoping pelvic restraint stand with a telescope locking means and a pelvic stabilizing means is slidably attached to the upper support shaft.

2. The Lumbar Extension Machine of claim 1, wherein the elongated base frame and the inverted Y-shaped lower shaft are rectangular in configuration and the base frame has two spaced apart holes therein for attachment of the inverted Y-shaped lower shaft thereto.

3. The Lumbar Extension Machine of claim 1, wherein the upper support shaft is rectangular in configuration and contains foot rests and lower extremity restraints near the bottom portion thereof.

4. The Lumbar Extension Machine of claim 1 wherein the upper support shaft is hollow on the inside and contains an opening near the top portion thereof.

5. The Lumbar Extension Machine according to claim 1, wherein the telescoping pelvic restraint stand is rectangular in configuration and contains a plurality of spaced holes along the side of said stand.

6. The Lumbar Extension Machine in accordance with claim 1, wherein the telescoping pelvic restraint contains two hip pads and handle bars which contain two pelvic restraints connected to the handle bars.

7. The Lumbar Extension Machine of claim 6, wherein the two hip pads, handle bars and pelvic restrains are located near the top portion of the telescoping pelvic restraint stand.

8. The Lumbar Extension Machine of claim 5, wherein the telescoping pelvic restraint stand is slidably attached to the upper support shaft using a spring loaded pull pin which fits into one of the spaced holes therein.

9. The Lumbar Extension Machine of claim 1, including a tighten down torsion knob located on the upper support shaft which exerts pressure on the telescoping pelvic restraint stand.

10. The Lumbar Extension Machine of claim 1, wherein the angle adjustment cam is rotatably attached to the top portion of the inverted Y-shaped, lower shaft by a cold roll cylindrical shaft which contains bronze oil light T-flange bushings on both ends.

11. The Lumbar Extension machine of claim 10, wherein the angle adjustment cam contains holes drilled therethrough at 15 degree angles.

12. The Lumbar Extension Machine of claim 1, wherein the inverted Y-shaped lower support shaft contains two outer members attached to an inner member.

13. The Lumbar Extension Machine of claim 12 wherein the two outer members of the inverted Y-shaped lower support stand contains matching holes drilled into the upper portion of the outer members.

14. The Lumbar Extension Machine of claim 11, wherein the locking means for the angle adjustment cam comprises a spring loaded pull pin that is attached to the upper portion of the inverted Y-shaped lower support stand and passes through one of the holes contained in said angle adjustment cam.

15. The Lumbar Extension Machine of claim 1, wherein the angle adjustment cam contains a rectangular shaped stop located near the open end portion of said cam to prevent the upper support shaft from extending past a level position at a negative angle.

* * * * *